US005242316A

United States Patent [19]

Gartzke et al.

[11] Patent Number: 5,242,316

[45] Date of Patent: Sep. 7, 1993

[54] MICROWAVE COAXIAL CONNECTOR

[75] Inventors: Donald G. Gartzke, Ipswich; Anthony R. Scannelli, Stoneham; Christopher Lewis, Southboro, all of Mass.

[73] Assignee: Dynawave Incorporated, Georgetown, Mass.

[21] Appl. No.: 979,979

[22] Filed: Nov. 23, 1992

[51] Int. Cl.[5] ..... H01R 9/05

[52] U.S. Cl. ..... 439/584; 439/654

[58] Field of Search ..... 439/578-585, 439/675, 638, 654, 840

[56] References Cited

U.S. PATENT DOCUMENTS

| | | | |
|---|---|---|---|
| 3,953,098 | 4/1976 | Avery et al. | 439/675 |
| 4,017,139 | 4/1977 | Nelson | 439/675 |
| 4,925,403 | 5/1990 | Zorzy | 439/578 |
| 4,963,105 | 10/1990 | Lewis et al. | 439/578 |
| 5,074,809 | 12/1991 | Rousseau | 439/578 |

*Primary Examiner*—David L. Pirlot

*Attorney, Agent, or Firm*—John E. Toupal; Harold G. Jarcho

[57] ABSTRACT

A coaxial connector including an outer conductor having a hollow cylindrical body portion and a plurality of substantially parallel, circumferentially spaced apart spring fingers extending longitudinally from the body portion, each of the fingers having a free end terminating with a radially outwardly projecting latch portion; an inner conductor disposed coaxially within the outer conductor; a cylindrical insulator member disposed between the inner and outer conductors; a hollow cylindrical and electrically conductive bushing surrounding the fingers and at least a section of the body portion, the bushing having an inner surface defining an annular recess receiving the latch portions; and an annular coiled, electrically conductive spring engaged between the body portion and the bushing. The spring fingers facilitate rapid interconnection of the outer conductor and the bushing while the spring provides RFI suppression.

20 Claims, 2 Drawing Sheets

MICROWAVE COAXIAL CONNECTOR

BACKGROUND OF THE INVENTION

This invention relates generally to an electrical connector assembly and, more particularly, to an electrical connector assembly for connecting coaxial radio frequency transmission lines.

Plug type connector assemblies are used commonly to facilitate quick connection and disconnection of circuit packages in electrical circuit systems. When used in certain applications such as for the transmission of rf signals, an important requirement of plug type connectors is that they exhibit a relatively low electrical signal disturbance characteristic in that signal interference or attenuation can significantly degrade the performance of an entire electrical system. Typical connectors for such applications are disclosed, for example, in U.S. Pat. Nos. 4,925,403; 5,074,809; and 4,963,105. The prior art connectors fail to provide completely satisfactory performance in all applications.

The object of this invention, therefore, is to provide for coaxial transmission lines an improved plug type connector assembly that combines a quick connect-disconnect capability with a low signal disturbance characteristic.

SUMMARY OF THE INVENTION

The invention is a coaxial connector including an outer conductor having a hollow cylindrical body portion and a plurality of substantially parallel, circumferentially spaced apart spring fingers extending longitudinally from the body portion, each of the fingers having a free end terminating with a radially outwardly projecting latch portion; an inner conductor disposed coaxially within the outer conductor; a cylindrical insulator member disposed between the inner and outer conductors; a hollow cylindrical and electrically conductive bushing surrounding the fingers and at least a section of the body portion, the bushing having an inner surface defining an annular recess receiving the latch portions; and an annular coiled, electrically conductive spring engaged between the body portion and the bushing. The spring fingers facilitate rapid interconnection of the outer conductor and the bushing while the spring provides rfi suppression.

According to one feature of the invention, the fingers are separated by slots having inner ends terminated by the body portion, and the spring is disposed inwardly of each of the inner ends. This feature enhances the rfi suppression characteristics of the spring by substantially eliminating rf leakage through the slots.

According to another feature of the invention, the bushing includes a radially inwardly projecting skirt portion that engages each of the free ends. The skirt portion helps properly locate the bushing on the outer conductor.

According to yet other features of the invention, the body portion includes longitudinally adjacent first and second portions, the first portion terminating the inner ends and defining a substantially cylindrical outer surface, said second portion defining a transverse surface extending radially outwardly from the outer surface, and the spring being engaged by both the outer surface and the transverse surface. These structural features establish secure confinement of the spring between the outer conductor and the bushing.

According to a further feature of the invention, the inner surface includes a tapered surface portion engaging the spring. The tapered surface maintains a desirable axially applied force on the spring.

According to still another feature of the invention, the bushing includes a knurled outer surface portion. The knurled outer surface portion facilitates retention of the assembly in a receiving opening of a circuit package.

According to additional features of the invention, the inner conductor defines an annular recess, the cylindrical insulator member defines a radially directed port communicating with said annular recess, and the assembly includes an electrically insulative adhesive substantially filling the recess and the port. These features establish a stable joining of the inner conductor and insulator member.

According to yet another feature of the invention, the body portion includes an annular, radially inwardly directed edge portion embedded in the cylindrical insulator member. The edge portion insures a secure structural combination for the outer and inner conductors. A preferred embodiment of the invention encompasses symmetrical connector halves each constructed in the above manner. This embodiment can be conveniently used to connect pairs of circuit packages.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
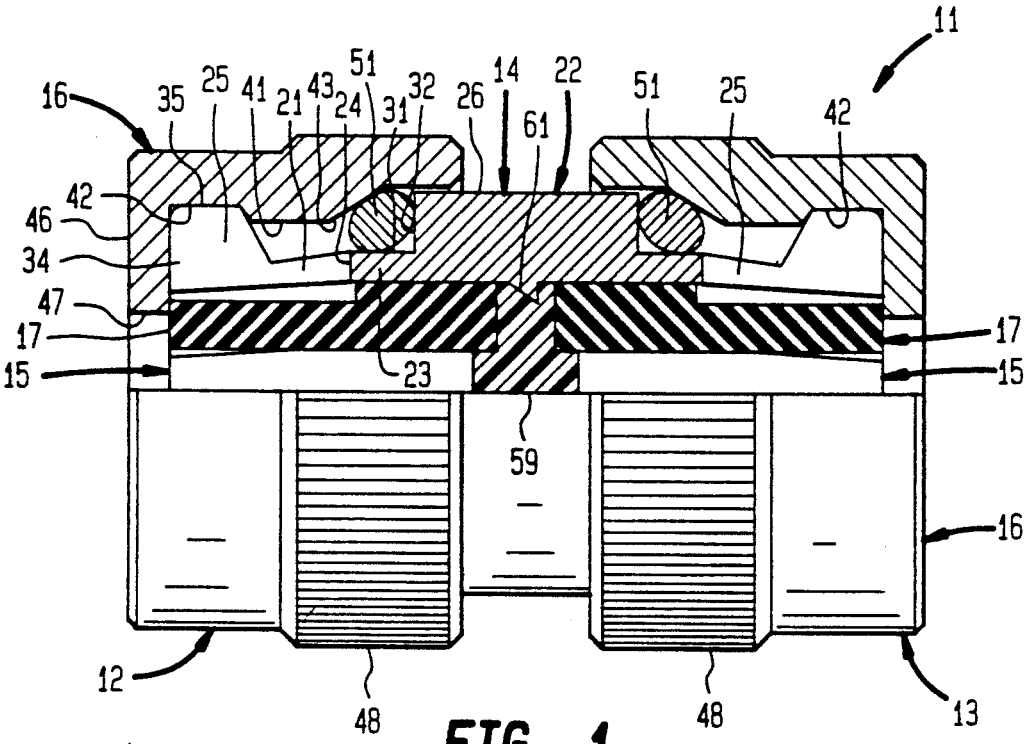
FIG. 1 is a partial longitudinal cross sectional view of a coaxial connector according to the invention.

An adapter 11 for rf coaxial transmission includes longitudinally symmetrical connector halves 12, 13. Since the connector halves 12, 13 are identical only one will be specifically described although common reference numerals are applied to identical components of each half. The connector 12 includes a cylindrical outer conductor 14, an inner conductor 15 defining a female socket and disposed concentrically within the outer conductor 14 and a hollow cylindrical, electrically conductive bushing 16 mounted on the outer conductor 14. Electrically isolating the outer conductor 14 from the inner conductor 15 is a cylindrical insulator member 17.

The outer conductor 14 includes a plurality of circumferentially spaced apart fingers 21 extending longitudinally from a cylindrical body portion 22. Included in the cylindrical body portion 22 is a first cylindrical body portion 23 that terminates inner ends 24 of slots 25 between the fingers 21 and a second cylindrical body portion 26 longitudinally adjoining the first body portion 23. Defined by the first body portion 23 is a longitudinally extending cylindrical outer surface 31 while the second body portion 26 defines a radial surface 32 extending transverse to the outer surface 31. A free end 34 of each finger 21 is terminated by a radially outwardly projecting latch portion 35.

The hollow bushing 16 has an inner surface 41 that surrounds the fingers 21 and a portion of the cylindrical body portion 22 of the outer conductor 14. Defined at an outer end of the inner surface 41 is an annular recess 42 that receives the outwardly projecting latch portions 35 of the fingers 21. Also defined by an inner portion of the inner surface 41 is a tapered surface portion 43 disposed adjacent to the outer surface 31 of the first body portion 23 and the transverse surface 32 of the second body portion 26. A radially inwardly projecting skirt portion 46 at the outer end of the bushing 16 projects substantially inwardly from a junction between the annular recess 42 and the inner surface 41. The skirt portion 46 engages an extreme terminus of each of the free ends 34 of the fingers 21 and forms a central opening 47 for accommodating an inner conductor (not shown) to be received by the inner conductor socket 15. An annular outer surface portion 48 of the bushing 16 is knurled so as to facilitate a secure frictional retention within a cylindrical cavity (not shown) of a circuit package (not shown). Forcibly engaged between the outer surface 31 of the first body portion 23, the transverse surface 32 of the second body portion 26 and the tapered surface portion 43 of the bushing 16 is an annular, coiled and canted spring 51 formed from a suitable electrically conductive spring material. A spring 51 suitable for use with the connector 12 is disclosed in U.S. Pat. No. 4,963,105.

Figure 2:
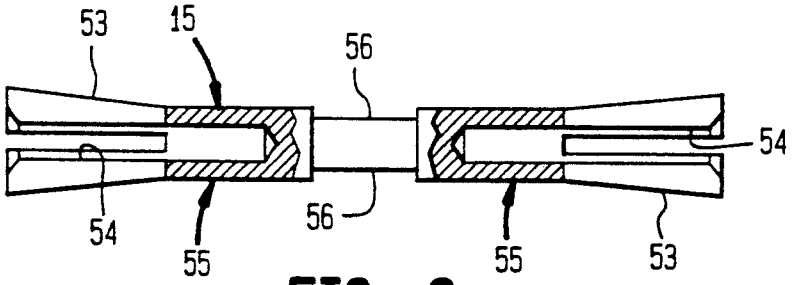
FIG. 2 is a longitudinal cross sectional view of an inner conductor utilized in the connector shown in FIG. 1.
Figure 3:
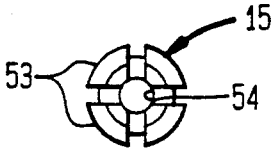
FIG. 3 is an end view of the inner conductor shown in FIG. 2.

As illustrated in FIGS. 2 and 3, the preferably machined inner conductor 15 has a plurality of circumferentially spaced apart legs 53 with ends arranged to define an entrance to a socket 54. The legs 53 project from an inner conductor body portion 55. Formed between the body portions 55 of the longitudinally adjacent halves of the center conductor 15 is an annular recess 56.

ASSEMBLY

Figure 4:
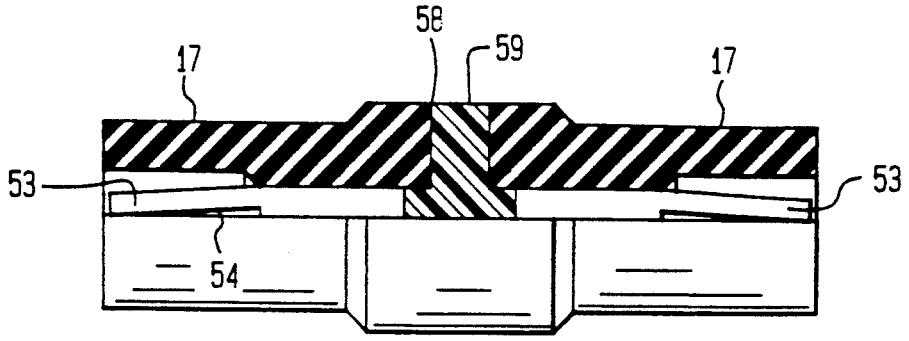
FIG. 4 is a partial longitudinal cross sectional view of an insulator inner conductor assembly utilized in the connector shown in FIG. 1.
Figure 5:
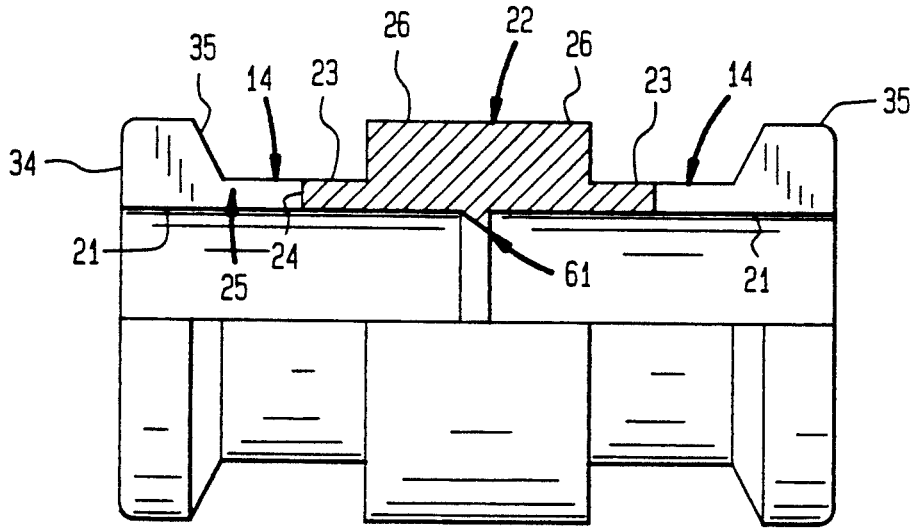
FIG. 5 is a partial longitudinal cross sectional view of an outer conductor utilized in the connector shown in FIG. 1.
Figure 6:
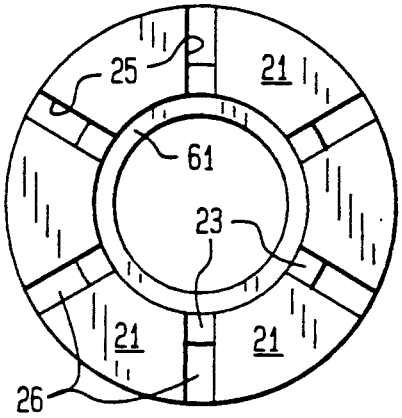
FIG. 6 is an end view of the outer conductor shown in FIG. 5.

After radially inward crimping of the legs 53 to partially close the sockets 54 as shown in FIG. 4, the inner conductor 15 is inserted into the cylindrical insulator member 17 that includes a centrally located port 58. The annular recess 56 is filled through the port 58 with a suitable electrically insulative epoxy 59 to create a secure bond between the inner conductor 15 and the insulator member 17. After assembly of the inner conductor 15 and insulator member 17, that unit is inserted into and axially aligned within the cylindrical body portion 22 of the outer conductor 14 as shown in FIG. 1. A proper axial alignment is retained by an annular radially inwardly directed edge portion 61 of the cylindrical body portion 22 which penetrates an outer surface of cylindrical insulator member 17. After mounting of the annular spring 51 between the outer surface 31 of the first body portion 23 and the transverse surface 32 of the second body portion 26, the bushing 16 is passed over the outer conductor 14 contracting the resilient fingers 21 until the latch portions 35 snap securely into the annular recess 42 and the free ends 34 engage the skirt portion 46 as shown in FIG. 1. With the bushing 16 in that position, the annular spring 51 is securely retained between the outer surface 31 of the first body portion 23, the transverse surface 32 of the second body portion 26 and the tapered surface portion 43 of the bushing 16. The engaged spring 51 and surfaces 31, 32 and 43 disposed internally of the ends of the slots 25 between the fingers 21 establishes an effective shield to rf leakage.

Obviously, many modifications and variations of the present invention are possible in light of the above teachings. It is to be understood, therefore, that the invention can be practiced otherwise than as specifically described.

We claim:

1. A coaxial connector comprising:

an outer conductor having a hollow cylindrical body portion; a plurality of substantially parallel, circumferentially spaced apart spring fingers extending longitudinally from said body portion; each of said fingers having a free end terminating with a radially outwardly projecting latch portion;

an inner conductor disposed coaxially within said outer conductor;

a cylindrical insulator member disposed between said inner and outer conductors;

a hollow cylindrical and electrically conductive bushing surrounding said fingers and at least a section of said body portion, said bushing having an inner surface defining annular recess means receiving said latch portions and a radially inwardly projecting skirt portion that engages an extreme terminus of each of said free ends; and an annular coiled, electrically conductive spring engaged between said body portions and said bushing.

2. A connector according to claim 1 wherein said skirt portion projects substantially radially inwardly from a junction between said annular recess means and said inner surface.

3. A connector according to claim 1 wherein the fingers are separated by slots having inner ends terminated by said body portion, and said spring is disposed inwardly of each of said inner ends.

4. A connector according to claim 3 wherein said spring is canted.

5. A connector according to claim 3 wherein said body portion includes longitudinally adjacent first and second portions, said first portion terminating said inner ends and defining a substantially cylindrical outer surface, said second portion defining a transverse surface extending radially outwardly from said outer surface, and said spring being engaged by both said outer surface and said transverse surface.

6. A connector according to claim 5 wherein said inner surface includes a tapered surface portion engaging said spring.

7. A connector according to claim 6 wherein said bushing includes a knurled outer surface portion.

8. A connector according to claim 7 wherein said inner conductor defines an annular recess, said cylindrical insulator member defines a radially directed port communicating with said annular recess, and including an electrically insulative adhesive substantially filling said recess and said port.

9. A connector according to claim 8 wherein said body portion includes an annular, radially inwardly directed edge portion embedded in said cylindrical insulator member.

10. A coaxial connector having axially symmetrical halves each comprising:

an outer conductor having a hollow cylindrical body portion;

a plurality of substantially parallel, circumferentially spaced apart spring fingers extending longitudinally from said body portion; each of said fingers having a free end terminating with a radially outwardly projecting latch portion;

an inner conductor disposed coaxially within said outer conductor;

a cylindrical insulator member disposed between said inner and outer conductors;

a hollow cylindrical and electrically conductive bushing surounding said fingers and at least a section of said body portion, said bushing having an inner surface defining annular recess means receiving said latch portions; and an annular coiled, electrically conductive spring engaged between said body portion and said bushing.

11. A connector according to claim 10 wherein said inner conductor is a female socket.

12. A connector according to claim 10 wherein said bushing includes a pair of radially inwardly projecting skirt portions, each engaging an extreme terminus of each of said free ends at opposite ends of said conductor.

13. A connector according to claim 10 wherein said skirt portion projects substantially radially inwardly from a junction between said annular recess means and said inner surface.

14. A connector according to claim 10 wherein said fingers are separated by slots having inner ends terminated by said body portion, and said spring is disposed inwardly of each of said inner ends.

15. A connector according to claim 14 wherein said spring is canted.

16. A connector according to claim 14 wherein said bushing includes a radially inwardly projecting skirt portion that engages each of said free ends.

17. A connector according to claim 16 wherein said body portion includes longitudinally adjacent first and second portions, said first portion terminating said inner ends and defining a substantially cylindrical outer surface, said second portion defining a transverse surface extending radially outwardly from said outer surface, and said spring being engaged by both said outer surface and said transverse surface.

18. A connector according to claim 17 wherein said inner surface includes a tapered surface portion engaging said spring.

19. A connector according to claim 18 wherein said bushing includes a knurled outer surface portion.

20. A connector according to claim 13 wherein said inner conductor defines an annular recess, said cylindrical insulator member defines a radially directed port communicating with said annular recess, and including an electrically insulative adhesive substantially filling said recess and said port.

* * * * *